United States Patent [19]

Young

[11] 4,221,010

[45] Sep. 9, 1980

[54] FLUSH TANK METERING DEVICE

[76] Inventor: Daniel J. Young, 3137 Capri Rd., Lake Park, Fla. 33410

[21] Appl. No.: 922,079

[22] Filed: Jul. 5, 1978

[51] Int. Cl.[2] ..... E03D 1/00; E03D 1/22; E03D 5/00

[52] U.S. Cl. ..... 4/346; 4/363; 4/420

[58] Field of Search ..... 4/1, 340–342, 4/345, 346, 353, 363, 364, 366, 367, 378, 415, 392, 393, 420; 141/105

[56] References Cited

U.S. PATENT DOCUMENTS

| | | | |
|---|---|---|---|
| 393,647 | 11/1888 | Hubert | 4/346 X |
| 2,458,096 | 1/1949 | Park | 4/346 |
| 3,972,076 | 8/1976 | Martine | 4/345 |
| 4,017,912 | 4/1977 | Young, Sr. | 4/345 |
| 4,017,914 | 4/1977 | Young, Sr. | 4/345 |

FOREIGN PATENT DOCUMENTS

| | | | |
|---|---|---|---|
| 6640 | of 1886 | United Kingdom | 4/345 |
| 28676 | of 1898 | United Kingdom | 4/353 |

*Primary Examiner*—Stuart S. Levy

*Attorney, Agent, or Firm*—Eugene F. Malin; Barry L. Haley; Philip R. Wadsworth

[57] ABSTRACT

A metering device to provide just the amount of water necessary to insure proper filling of a flush toilet bowl and trap. The metering device operates by means of gravity feed rather than pressure that is presently used which may vary the amount of water going to the trap as supply pressures increase or decrease. The metering device eliminates certain wasted water normally present during flushing and filling of the flush tank. The device in one embodiment includes a metering tank having an inlet connected to the exit sides of flush tank outlet valve. The flush tank outlet valve is connected at the upper side of the metering tank. The metering tank is in fluid communication between the flush tank and the toilet bowl and trap. The metering tank may be located in a plurality of lower positions. When the outlet valve is opened, the metering tank is also opened and filled during the flushing cycle. When the flush valve closes, a measured amount of water is in the metering tank which is then drained by gravity into the toilet bowl to fill the bowl and trap to its proper level.

1 Claim, 8 Drawing Figures

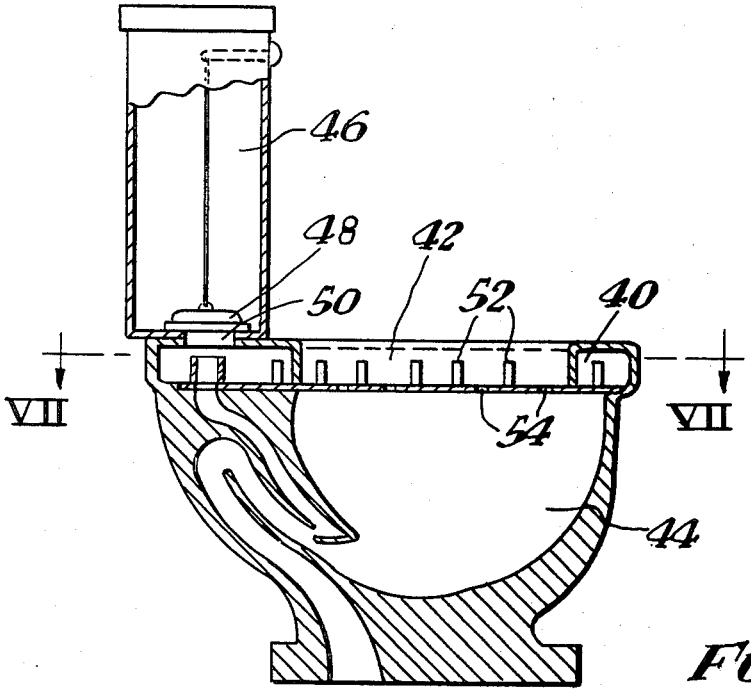
Fig. 6.
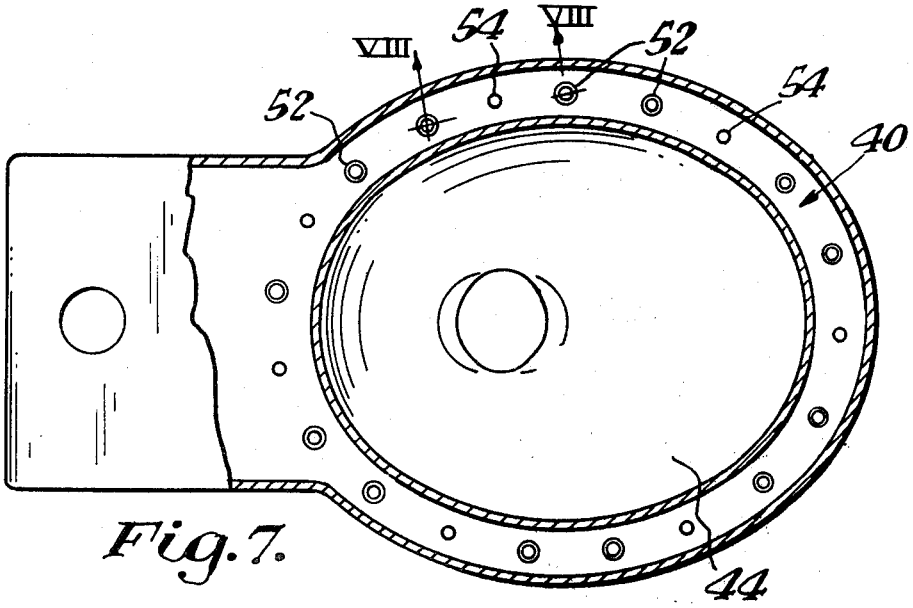
Fig. 7.
Fig. 8.
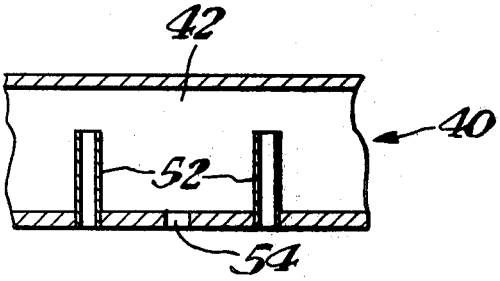

FLUSH TANK METERING DEVICE

BACKGROUND OF THE INVENTION

This invention relates generally to a device that is installed in a toilet flush tank or below the flush tank in the line from the flush tank to the toilet bowl or in the toilet bowl itself. This invention meters the amount of water received into the flush bowl and trap after the flush. This invention regulates the volume of water received into the flush bowl to seal the trap after flushing to eliminate the use of excess water that is automatically wasted.

In the conventional flush tank, the inlet valve that fills the flush tank includes a conduit into the overflow tube to supply additional water to the bowl to seal the trap after the flush tank outlet valve (ball or flapper) is closed. Normally, the outlet valve supplies excessive water to the flush bowl to seal the trap. Due to varying supply pressure, the volume used will vary. Also, the disclosure in U.S. Pat. Nos. 4,017,912 and 4,017,914, by Daniel J. Young, Sr., shows a metering tank that requires special siphons and regulation valves.

The present invention overcomes the problems of waste due to varying pressures, the necessity of structure for supplying water into the overflow tube for use in the toilet bowl and trap during the filling cycle of the flush tank. There is no necessity for a special siphon or control tubing to allow the metering tank to be filled during the ordinary flushing operation.

BRIEF DESCRIPTION OF THE INVENTION

A metering device which allows for the filling of a toilet flush bowl and trap with a precise quantity of water after the flush tank valve has closed. The metering device includes a metering tank having a predetermined volume, flush tank outlet valve opening into the metering tank as well as into an outlet conduit connected to the toilet bowl for flushing. In one embodiment, the metering tank surrounds an internal conduit having a plurality of apertures disposed through the conduit into the metering tank. The upper portion of the internal conduit is positioned in a larger opening in the top of the metering tank. The flush valve seals in the larger opening. The outlet of the internal conduit leads into the flush bowl and trap. The plurality of apertures in the walls of the internal conduit are disposed therein to allow for fluid flow from the metering tank back into the conduit between the flush tank and the toilet bowl. The upper surface valve opening of the metering tank is slightly larger than the internal conduit disposed therein such that when the flush tank valve is opened, water in the flush tank also flows into the metering tank, filling the metering tank during flushing. Once the flush valve closes, the water trapped in the metering tank will flow by gravity or siphon into the flush bowl and trap to effect complete filling of the bowl and trap.

To install the preferred metering device, the metering tank and conduit is connected at the base of the flush tank to the conduit leading to the toilet bowl and trap inlet. An air inlet tube is connected to the flush tank to allow air to flow into the metering tank when the flush valve is closed and the water is exiting the metering tank.

It is an object of this invention to provide a metering device for use with a toilet flush tank which eliminates water waste during the flushing refill operation.

It is another object of this invention to provide a flush tank metering device that eliminates filling of the flush bowl and trap through the conventional overflow tube to eliminate the pressure factor that varies the volume.

It is another object of this invention to provide a non-complex structure that may easily be installed.

An additional object of this invention is to provide a metering tank that is filled by a portion of the direct flow of the flush tank water during the flush cycle.

In accordance with these and other objects which will be apparent hereinafter, the instant invention will now be described with particular reference to the accompanying drawings.

BRIEF DESCRIPTION OF THE DRAWINGS

FIG. 6 is an elevational view of another embodiment of the present invention taken in cross-section along the center line of a toilet.

FIG. 7 is a cross-sectional view of FIG. 6 taken along lines VII—VII.

FIG. 8 is an exploded cross-sectional view of FIG. 7 taken along lines VIII—VIII showing the detail of the metering device.

PREFERRED EMBODIMENT OF THE INVENTION

Figure 1:
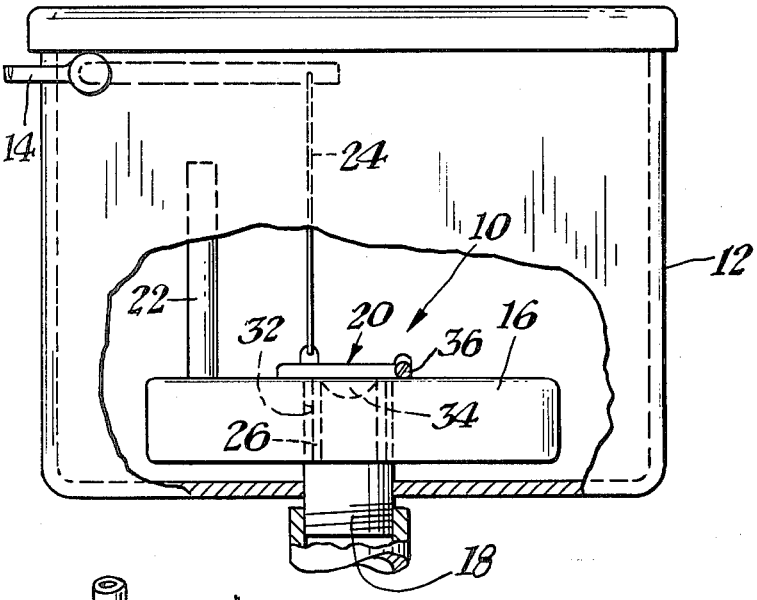
FIG. 1 shows a front elevational view of a conventional flush tank partially broken away showing the present invention mounted therein.
Figure 3:
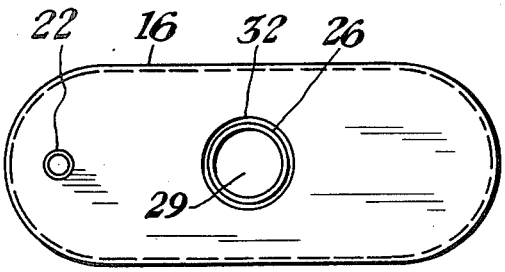
FIG. 3 shows a top plan view of the present invention.
Figure 5:
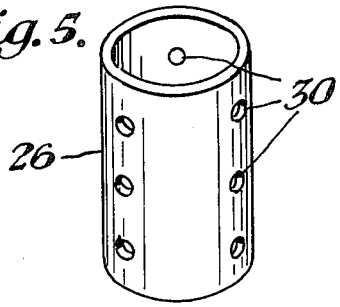
FIG. 5 shows a perspective view of the conduit utilized with the instant invention.

Referring now to the drawings and especially FIG. 1, a metering device in accordance with the instant invention is shown generally at 10 installed in a conventional flush tank 12. The toilet flush tank is emptied manually by lever arm 14 which is connected to a flush valve 20 by a connecting means or chain 24. The flush valve 20 is pivotally mounted adjacent an aperture 29 as shown in FIG. 3 on the top of metering tank 16. The flush valve 20 has a generally resilient body and a hollow float area 34 and a pivotable connector means 36. Tank 16 has a lower surface opening connected to flush tank outlet 18 which leads to the flush bowl and trap (not shown).

Figure 2:
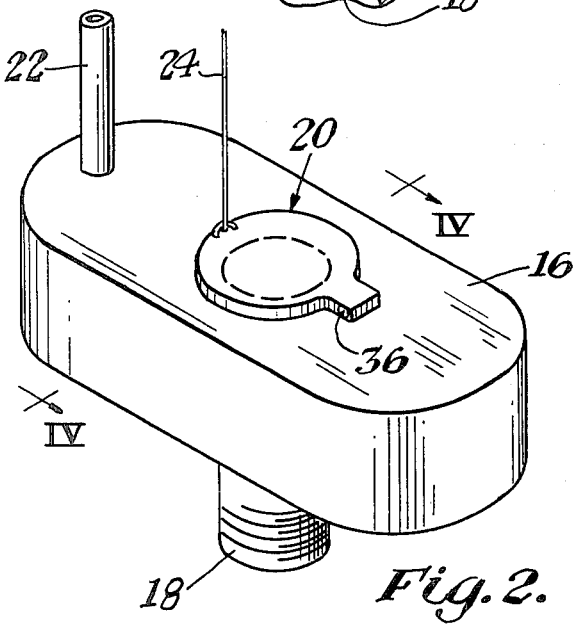
FIG. 2 shows a perspective view of the present invention.

Referring now to FIG. 2, tank 16 is shown which has a predetermined volume and includes an air inlet vent tube 22 connected into the tank and extending upward above the maximum water level of the flush tank 12, the tube length being such that the tube is vertically disposed of sufficient height to allow air flow into the metering tank 16 so that water in the metering tank 16 will drain properly by gravity.

FIG. 2 shows the metering tank 16 connected by outlet conduit 18 which is the outlet to the flush bowl and trap. The outlet 18 is sealed around the base of the metering tank 16 and is in fluid communication with an intermediate conduit 26. The conduit 26 is disposed between the opening in the top of the metering tank and the outlet 18. The top of conduit 26 does not contact the perimeter of opening 29. The outside diameter of conduit 26 is smaller than opening 29. This allows water to flow into tank 26 when valve 20 is opened. The water flows out of tank 26 through opening 30 at a slower rate than the inflow through opening 32. In a preferred embodiment, there is need for only two openings 30. The lower openings would be used mounted on top of the metering tank 16 is a flush valve 20 which provides for a pivotal sealing closure that is actuated by a cable or chain 24 connected to manual lever 14 (FIG. 1) that actuates the flush tank. The flush valve 20 is, in effect, the outlet valve which allows water to flow from the flush tank 12 into the bowl to flush the bowl. A vent tube 22 is connected through the top of tank 16 to allow air to be received into the tank for proper filling, draining, and emptying of the tank 16. The top of vent 22 should be disposed above the water level of the flush tank when the flush tank 12 is filled.

Figure 4:
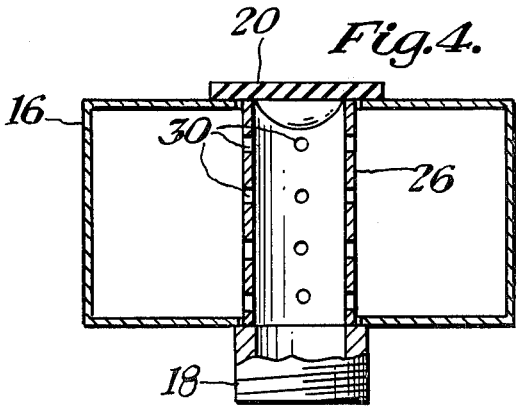
FIG. 4 is a cross-sectional view of FIG. 2 taken along lines IV—IV and looking in the direction of the arrows.

Referring now to FIGS. 3 and 4, the conduit 26 is shown in FIG. 3 with the flush valve removed to show that the aperture 32 which is sealed by the flush valve is slightly larger in diameter than the diameter of conduit 26 disposed therein. This allows for filling of the metering tank 16 from the flush tank 12 when the flush valve 20 is open.

FIG. 6 shows the metering device in the bowl itself, such as along the rim 40. The risers 41 are connected to openings 42. The cavity 40 is filled like cavity 16 and supplies the trap water after the main flush.

In operation, when the manual lever 14 is actuated, the flush valve is lifted, dumping water from the flush tank 12 down through conduit 26 in metering tank 16 into the outlet 18 and also down through aperture 32 into metering tank 16. After the flush tank empties, the flush valve closes, but not before the meter tank 16 is filled. Once the flush valve is closed, the metering tank empties by gravity, filling the flush bowl and trap with the proper amount of water. The intermediate conduit 26 includes small holes 30 to aid in draining the metering tank 16 after the flush valve 20 is closed. Thus, no additional water is wasted while the flush tank is being filled since the overflow tube is not utilized to augment filling of the flush bowl and trap.

The amount of water in metering tank 16 is sufficient to supplement water remaining in the flush tank bowl to bring the level in the bowl sufficiently high to allow proper siphon action on the next flushing. Since excessive amounts of water are not being dumped into the toilet bowl during the filling of the flush tank 12, each flush saves a significant portion of water which would conventionally or ordinarily have been poured into the flush bowl while the tank is refilling.

FIGS. 6, 7, and 8 illustrate another embodiment of the present invention in which the metering device, shown generally by the numeral 40 is integrated into the discharge conduit 42, such that the metering device 40 may be molded into a toilet during manufacture or easily added afterwards.

The discharge conduit 42 is circumscribed about the toilet bowl 44 and is in fluid communication with the flush tank 46 through a flush valve 48 and flush tank outlet 50. The discharge conduit 42 has a plurality of generally vertical risers 52 and a plurality of apertures 54 connecting the discharge conduit 42 with the toilet bowl 44.

In operation, when the flush valve 48 is opened, the fluid stored in the flush tank 46 is discharged through the flush tank outlet 50 into the discharge conduit 42. Since the discharge area of the apertures 54 is smaller than the flush tank outlet 50, the major portion of the discharged fluid will rise in the discharge conduit 42 and flow out the risers 52 to flush the toilet bowl 44. After the flush tank 46 is empty and the flush valve 48 is closed, the remaining portion of the discharge fluid in the discharge conduit 42 will drop below the top of the risers 52 and drain out through the apertures 54 to fill the flush bowl with a metered amount of water. In a preferred embodiment, there is need for only two openings at any of the locations shown. Thus, no additional water is discharged through the overflow tube to fill and seal the flush bowl and trap.

It should be noted that a siphon arrangement may be used instead of gravity feed in FIGS. 4 and 6 or when the design calls for such a means to raise the water over a lip.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A liquid metering device for use in a conventional flush toilet having a manual flush lever, for providing the proper amount of sealing water to the flush bowl from a flush tank after a flush, said liquid metering device comprising:

a metering tank, sized to fit within a conventional toilet flush tank, for holding liquid discharged from said flush tank having contiguous side portion, upper portion and lower portion, said bottom portion having at least one aperture therethrough, said top portion having first and second apertures therethrough, said first top portion aperture conincident above said bottom portion aperture and having a generally larger diameter than said bottom portion aperture, a conduit means of generally uniform diameter having at least one aperture through the side wall disposed between said coincident apertures in said metering tank whereby said conduit means is generally in intimate contact with said bottom portion aperture so as to form a seal between said conduit means and said bottom portion aperture, a valve means being sufficiently large and resilient to entirely cover said first top portion aperture to prevent draining of liquid from said flush tank when said valve means is closed, said conduit means is generally flush with the top portion of said metering tank thereby being spaced from said first top portion aperture sufficient to allow said metering tank to fill with liquid from said flush tank when said valve means is open, and an air conduit means gaseously connected to said second top portion aperture at one end and being sufficiently long to extend the other end above the normal liquid level in said flush tank, said valve means movably connected to the top portion of said metering tank for use in allowing liquid in said flush tank to drain through said first top portion aperture when said valve means is open, an actuating link attached between said valve means and said manual flush lever, and a connecting conduit means attached to said bottom portion aperture whereby said metering tank will be secured to said flush toilet.

* * * * *